US007726076B2

(12) United States Patent
Staub

(10) Patent No.: US 7,726,076 B2
(45) Date of Patent: Jun. 1, 2010

(54) GUTTER COVER WITH A CLIP AND METHOD OF INSTALLING THE SAME

(75) Inventor: Timothy G. Staub, Midlothian, VA (US)

(73) Assignee: Elko Products Company, Inc., Richmond, VA (US)

( * ) Notice: Subject to any disclaimer, the term of this patent is extended or adjusted under 35 U.S.C. 154(b) by 1256 days.

(21) Appl. No.: 11/188,399

(22) Filed: Jul. 25, 2005

(65) Prior Publication Data

US 2007/0017162 A1 Jan. 25, 2007

(51) Int. Cl.
*E04D 13/064* (2006.01)

(52) U.S. Cl. ..... 52/11; 52/12; 52/15

(58) Field of Classification Search ..... 52/11, 52/12, 15, 13; 248/48.1, 48.2
See application file for complete search history.

(56) References Cited

U.S. PATENT DOCUMENTS

| | | | | |
|---|---|---|---|---|
| 2,734,467 | A | 2/1956 | Steele | |
| 3,420,378 | A | 1/1969 | Turner | |
| 4,036,761 | A | 7/1977 | Rankin | |
| 4,307,976 | A | 12/1981 | Butler | |
| 4,467,570 | A | 8/1984 | Kriegel | |
| 4,750,300 | A | 6/1988 | Winger, Jr. | |
| 4,796,390 | A | 1/1989 | Demartini | |
| 5,056,276 | A | 10/1991 | Nielsen et al. | |
| 5,271,192 | A * | 12/1993 | Nothum et al. | 52/12 |
| 5,459,965 | A | 10/1995 | Meckstroth | |
| 5,495,694 | A | 3/1996 | Kuhns | |
| 5,611,175 | A | 3/1997 | Sweers | |
| 5,640,809 | A | 6/1997 | Iannelli | |
| 5,819,476 | A | 10/1998 | Annestedt, Sr. | |
| 5,845,435 | A | 12/1998 | Knudson | |
| 5,966,875 | A | 10/1999 | Kuhns | |
| D416,079 | S | 11/1999 | Hallett, II | |
| 6,016,631 | A | 1/2000 | Lowrie, III | |
| 6,098,344 | A | 8/2000 | Allbracht | |
| 6,098,345 | A | 8/2000 | Demartini et al. | |
| 6,269,592 | B1 | 8/2001 | Rutter | |
| 6,543,729 | B1 * | 4/2003 | Ylonen | 248/48.1 |
| 6,672,012 | B2 | 1/2004 | Bahroos et al. | |
| 6,681,527 | B2 | 1/2004 | Baker | |
| D487,868 | S | 3/2004 | Richard | |
| 6,735,907 | B2 | 5/2004 | Stevens | |
| 2002/0069594 | A1 | 6/2002 | Sweet | |
| 2004/0211125 | A1 | 10/2004 | Kuhns | |
| 2004/0244305 | A1 | 12/2004 | Hurst | |

* cited by examiner

*Primary Examiner*—Phi Dieu Tran A
(74) *Attorney, Agent, or Firm*—Thomas, Karceski, Raring & Teague, P.C.

(57) ABSTRACT

A gutter cover with clip is provided that operates with a variety of gutter styles to capture roof runoff while preventing debris from entering the gutter. The gutter cover is an elongated panel of sufficient width to bridge a roof to the far side of the gutter. A radiused edge is provided to direct roof runoff into the gutter. The clip includes a mounting tab and an upward rising arm. A tooth on the arm positively engages an aperture in the radiused edge to facilitate extremely accurate, fast, and resilient installation of a gutter cover system.

22 Claims, 4 Drawing Sheets

GUTTER COVER WITH A CLIP AND METHOD OF INSTALLING THE SAME

FIELD OF THE INVENTION

The present invention relates to gutter cover system and a method of installing the same, the system including a gutter cover with a clip that, when installed, acts to direct water into a gutter while prohibiting debris or solid matter in the water from entering the gutter. More specifically, an improved gutter cover with a clip is provided for extremely accurate, fast, and resilient installation of a gutter cover system.

BACKGROUND OF THE INVENTION

Sloped roofs are visually appealing and help to reduce maintenance by shedding rain water, snow or other precipitation. It is important, however, that the precipitation not be allowed to stand or collect at the base of the structure, which could lead to structural instability, rot, mold, insect infestation, and the like. Accordingly, gutters are nearly universally installed around the sloped roof lines of residential dwellings, commercial and governmental structures. Precipitation from the sloped roof is captured in the gutter's trough and directed to a downspout that directs the precipitation away from the base of a structure.

Roofs also capture a variety of debris such as leaves, twigs, pine needles, seeds and the like. This debris is then washed or blown into the roof's gutters. The debris clogs gutters, which leads to precipitation overflowing the gutter and the aforementioned problems. Water trapped in a gutter also leads to plant growth, deterioration of the gutter, and insect infestation. The gutters must be periodically cleaned to prevent the debris from causing a clog.

In response, there have been significant attempts to develop a device that permits water to enter a gutter while prohibiting debris. Many of these devices, including screens, have been ineffective at best. A more successful variation is found in the class of products wherein an elongated, unperforated gutter cover bridges the gutter's trough from a roof. The width of the cover is typically sufficient to extend from the roof to the outer edge of a gutter. The edge of the cover adjacent the gutter's outer edge is curved, bent or has a radius. As water runs off the roof, it encounters the cover that bridges the roof line to the far side of the gutter. Due to natural surface tension, the water tracks around the radiused or bent gutter edge and is directed into the gutter. Debris is naturally separated from the water along the curled edge so that the debris does not collect in the gutter.

The elongated, essentially flat gutter cover can be difficult to install as it does not include much bending flexibility in the transverse (edge to edge) direction. One installation technique is to place the gutter cover's roof edge under a row of shingles. This can be extremely difficult if the cover itself is not sufficiently flexible.

Steeply pitched roofs can also render existing covers ineffective. The steep pitch means liquid precipitation will exit the roof at a relatively high velocity. The high velocity can create enough force that the surface tension is insufficient to retain the water along the outer edge. As such, the water does not enter the gutter. Attempts have been made to reduce the flow rate of the water in these installations.

Gutter covers may be fastened directly to the roof during installation to secure the cover and/or to create sufficient structural rigidity. The fasteners typically create holes in the roof that can permit moisture, and thus decay, to pass through the roof. Roofs are specifically designed to prohibit moisture from passing through the roof so this is a very unsatisfactory approach to gutter cover installation.

To avoid puncturing the roof, some gutter covers include a clip that fastens the gutter cover to the gutter. The roof edge of the gutter cover is held in place by shingles. Installing clips can be more time consuming than simply nailing or fastening the cover to the roof, but the clips must be installed so that the cover is resiliently installed. Also, each cover is designed to be specifically positioned with respect to the gutter. The positioning is set when a clip is fastened to the gutter, but existing clips can create critical variations in positioning that may reduce the effectiveness and/or aesthetics of an installed gutter cover system.

Given the above and additional considerations, there remains a need for a gutter cover with a clip that provides an accurate, fast, and resilient installation of a gutter cover system. Ideally, the gutter cover system would be easy to install, would set the appropriate location of the gutter cover relative to a gutter during installation, and would adequately hold the gutter cover in place. A gutter cover with a clip in accordance with the present invention overcomes the above and other shortcomings found in existing gutter cover systems.

SUMMARY OF THE INVENTION

In accordance with the present invention, a gutter cover system and method of installing the same is provided that enables an extremely accurate, fast, and resilient installation of a gutter cover system. The gutter cover system includes a gutter cover with a clip. The cover is an elongated panel with two, lengthwise edges. A roof edge is in contact with a roof while a radiused gutter edge is secured proximate to a gutter via the clip. Spaced apertures in the lower half of the radiused or bent gutter edge are penetrated by the clip. The present invention overcomes the foregoing drawbacks and provides a gutter cover with a clip that solves those and other problems.

In a preferred embodiment, the clip is constructed so that installation of the cover and clip dictates the gap and location of the gutter cover relative a gutter without requiring manual measurements.

In another preferred embodiment, a plurality of recessed channels are created in the upper surface of the gutter cover increase the cover's flexibility, enhance aesthetics and/or decrease the velocity of the water crossing the gutter cover. The roof edge of the gutter may be placed under the first row of roof shingles. The recessed channel allows the cover to bend to create a flatter, less visible surface.

In yet another preferred embodiment, and in more detail, the device of the present invention comprises a gutter, an elongated gutter cover including one radiused edge, a plurality of apertures in the radiused edge, and a clip to secure the cover to the gutter. The clip comprises a gutter mounting tab secured to the gutter, a body extending substantially towards a roof from the tab and in-plane with the tab, and a bendable arm that rises at an angle from the body. The bendable arm including a first upward leg, a second downward leg, and a near vertical tooth on the downward leg. The tooth is inserted into one of the apertures in the radiused edge. The bendable arm may create a natural downward biasing force against the cover.

In still another preferred embodiment, the clip provides an arm rising at an upward angle from the arm. The arm includes a range of motion that allows the arm to be manipulated with respect to the clip, but the arm also includes a biasing force that urges the arm back to an at-rest position. The arm can include a triangular or pointed tooth that does not penetrate the cover.

In use, an installer selects an appropriately sized gutter cover panel. The clips are connected to the cover by aligning the clips' teeth with the apertures provided in the radiused edge. A first edge of the cover is placed under a row of shingles on the roof. If necessary, the cover can be bent in the transverse direction to account for the slope of the roof or to facilitate placement of the panel under the shingles. The installer then places the mounting tab of the clip flush against the upper edge of the outside gutter wall. The tab is placed as far forward as the structure of the clip allows. The clip mounting tab is then fastened to the gutter. In the event of a non-penetrating clip, the system would be installed accordingly.

The foregoing and additional features and advantages of the present invention will become apparent to those of skill in the art from the following detailed description of a preferred embodiment taken in conjunction with the accompanying drawings.

DETAILED DESCRIPTION OF A PREFERRED EMBODIMENT

Known gutter covers with clips include specifically shaped clips intended to facilitate installation and improve the effectiveness of the associate gutter cover. The known clips are deficient, however, because they are typically not positively secured to the cover and, if they are positively secured, the securement method is difficult or time consuming to install, the spacing of the gutter cover relative to the gutter is not properly controlled, and the like. The covers also tend to be inflexible in the widthwise direction. The clips are also inflexible and do not provide a bendable arm to hold a cover to a gutter.

Figure 1:
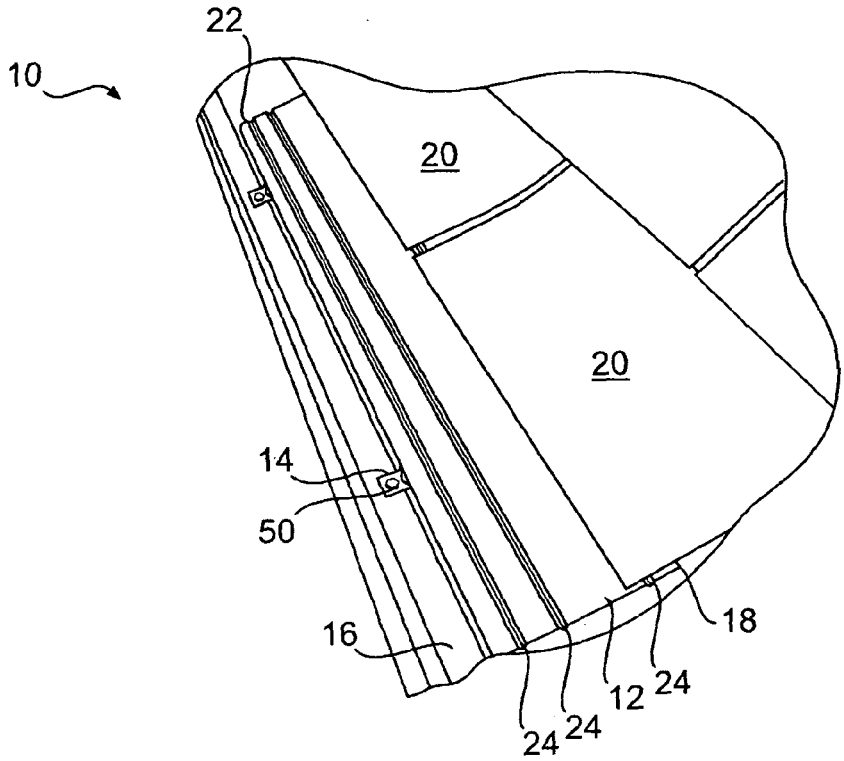
FIG. 1 is a three-quarter perspective view of a gutter cover with a clip wherein the cover is installed along a roof and secured to a gutter in accordance with the present invention.
Figure 2:
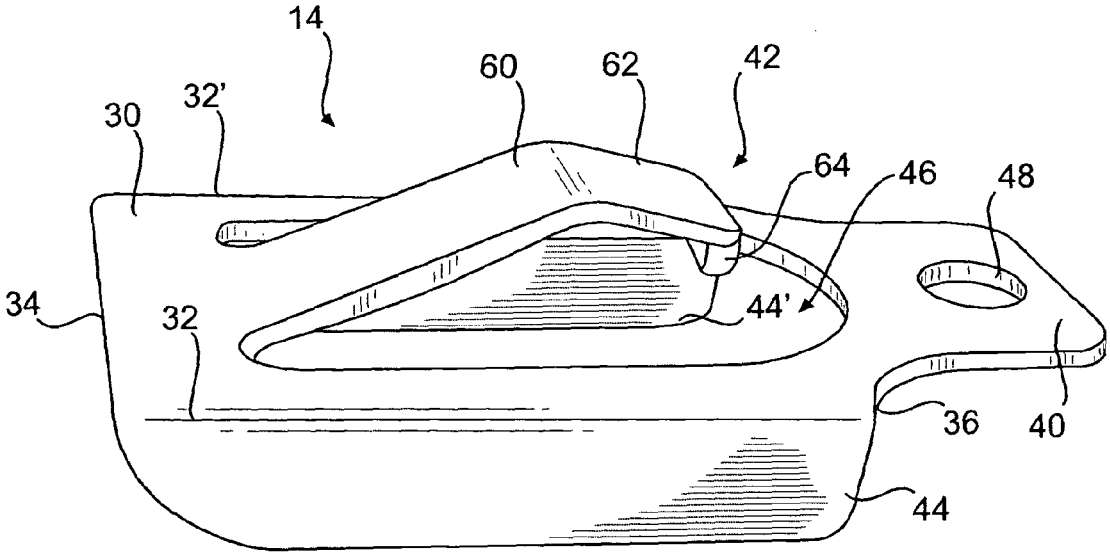
FIG. 2 is a three-quarter, side perspective view of the clip of FIG. 1.
Figure 3:
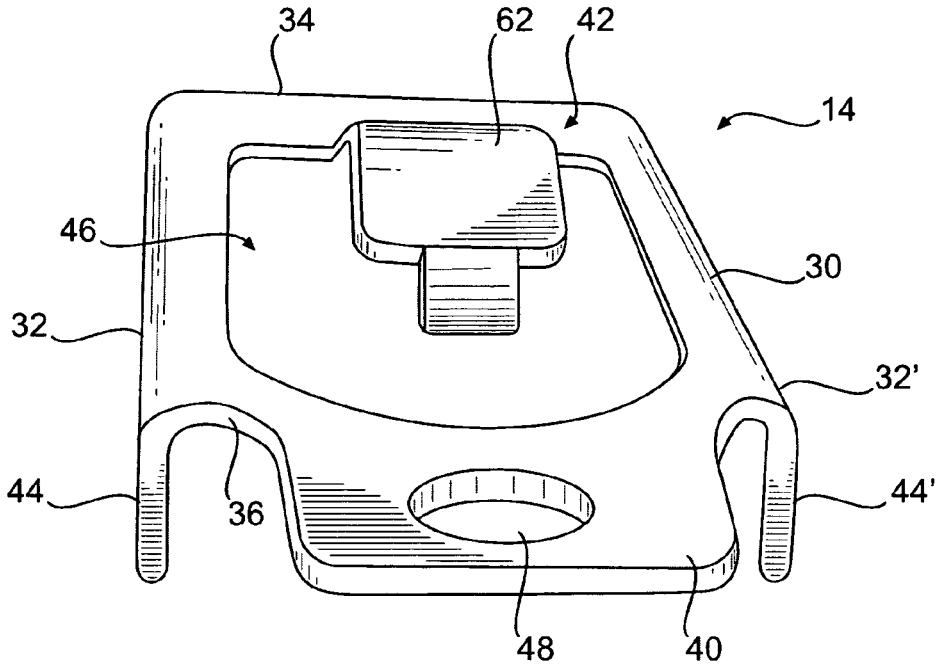
FIG. 3 is a three-quarter, front perspective view thereof.
Figure 4:
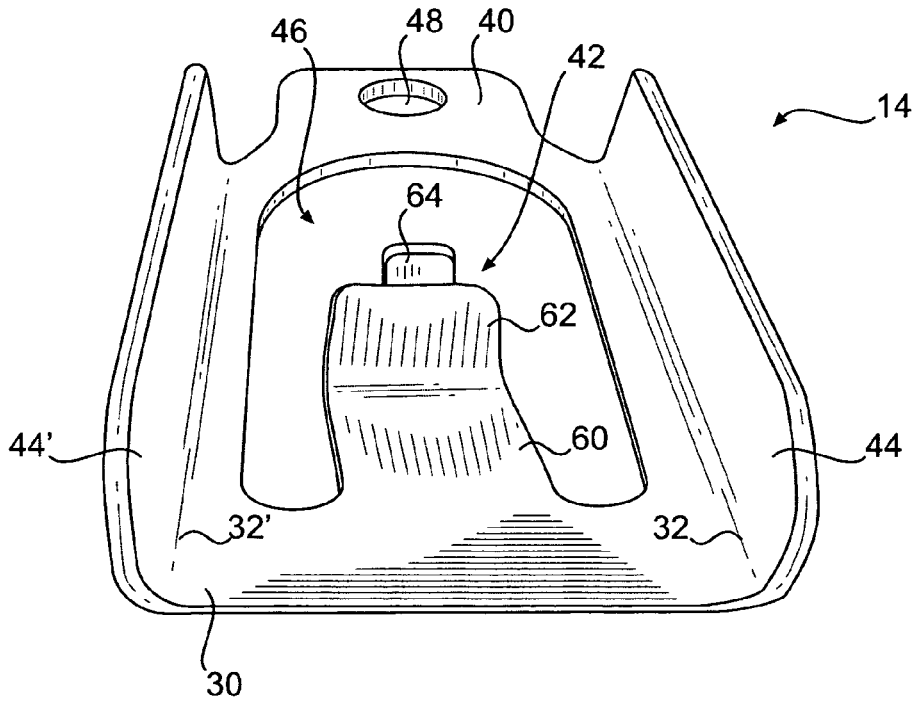
FIG. 4 is a three-quarter, rear view from a perspective beneath the clip.

The present invention will now be described in the context of one or more preferred embodiments. FIG. 1 illustrates a gutter cover system 10 in accordance with the present invention. A cover 12 is held by a clip 14 to a gutter 16. Gutter cover 12 is an elongated piece of material of sufficient width to bridge the distance between a roof line and the outer wall of a gutter. The cover can be formed from any suitable material including plastic, metal or the like. Gutter 16 generally defines a trough that captures roof run-off and directs the run-off to a downspout.

A first, roof edge 18 of cover 12 is placed under one or more rows of shingles 20 positioned in the horizontal direction of a roof's pitch. Water is transmitted along the roof's pitch. As the water or run-off reaches the edge of the last row of shingles 20, it is passed to gutter cover 12.

A second, gutter edge 22 of cover 12 is curled or otherwise provides a radius or bent edge that redirects run-off down and slightly back into gutter 16. The run-off follows curled, radiused, bent, etc. edge 22 due to natural surface tension, as is known in the art. Debris that may be contained in the water is projected from cover 12 beyond gutter 16. The dimensions of such a bent or curled edge are well established in the art and are obvious to one of skill in the art.

A number of channels or grooves 24 can be moulded, pressed, crimped or are otherwise formed by conventional means in cover 12 in the lengthwise direction of the cover (i.e., channels 24 are parallel to both roof edge 18 and gutter edge 22). In a preferred embodiment, at least one channel is located beneath shingles 20. Because the roof's pitch and the angle of cover 12 necessary to bridge gutter 16 are rarely exactly the same, the sub-shingle channel allows cover 12 to be buckled or bent in a the widthwise direction (see, e.g., FIG. 7). A channel does not need to be placed under shingles 20 to provide an effective means to bend cover 12. Additional channels are thought to act as a mechanism to reduce the velocity of the water or run-off as it approaches the curved edge. The channels also provide an upgraded aesthetic over a planar gutter cover.

The illustrated system comprises one embodiment of the present invention, but it is to be understood that one of ordinary skill in the art will be able to create a gutter protection system that incorporates the teachings of the present invention but which may look different and incorporate different, alternative parts without leaving the scope of the invention, as claimed below.

Turning now to FIGS. 2 through 6, there is illustrated clip 14 used to secure cover 12 to gutter 16. The clip comprises a main, planar body 30 that has a substantially rectangular shape with two, elongated sides 32, 32' and a first, rear end 34 and second, front end 36. A forward projecting mounting tab 40 is in-plane with, and extends from, body 30 beyond front end 36. The clip, as illustrated, further includes an upwardly rising and forward facing arm 42, and downwardly turned wings 44, 44'. The wings turn down from, and run the length of, the elongated sides 32, 32'. A semi-oblong opening 46 in body 30 creates a fluid passage in the clip. Arm 42 is positioned above opening 46.

A fastener opening 46 in mounting tab 40 provides an aperture through which a fastener can be inserted to secure clip 14 to gutter 16 with rear edge 34 facing the roof line. Fasteners or other means will secure tab 40 to gutter 16 including, but not limited to, self tapping screws, rivets, nails, adhesives, or the like. A fastener 50 (see FIG. 5) can include a washer (illustrated but not labelled).

It is envisioned that clip 14 will be manufactured from any number of materials and by any applicable technique. In a preferred embodiment, the clip is stamped from a sheet of stainless steel of appropriate thickness to provide suitable strength. As will be discussed further below, the arm is constructed to be movable or manipulable with respect to body 30 so that it rotates, to some degree, around the interface between the arm and the body. Stainless steel allows this spring-like resiliency so that an installer can actuate the arm. The bias built into the arm by known techniques urges the arm to return to an "at rest" or unactuated position. Other materials, including aluminum, plastics and the like can provide similar characteristics. For instance, a plastic clip could be injected moulded to have a biased arm.

In a preferred embodiment, and in greater detail, arm 42 includes a first upward leg 60 and a second downward leg 62. The geometry of the arm is such that the distal end of the second leg is still above the plane defined by body 30.

A downward, substantially rectangular tooth 64 is located at the distal end of arm 42. The tooth is also positioned above the plane defined by body 30. In use, tooth 64 is aligned within a preformed aperture (not shown) in the cover that is shaped and sized to accept the tooth. The apertures are located in a spaced relationship along the lower portion of the cover's curved edge. The bias force created by arm 42 urges tooth 64 into the respective aperture (see FIG. 6). The region between upward leg 60 and downward leg 62 effectively forms an elbow that helps to ensure a connection between the clip and the cover. The elbow effectively increases the downward bias on the tooth and facilitates a snap-like engagement with the gutter cover.

In another embodiment, the arm comprises one straight or partially curved leg that rises above the body of the clip (i.e. the two legs and elbow are eliminated). The arm still includes a tooth. The tooth could take several shapes in either embodiment. In one preferred embodiment, the tooth is triangular with a tip to engage the cover's curled edge without penetrating the edge. This embodiment is not illustrated, but one skilled in the art will appreciate that various configurations of the clip are possible.

Figure 7:
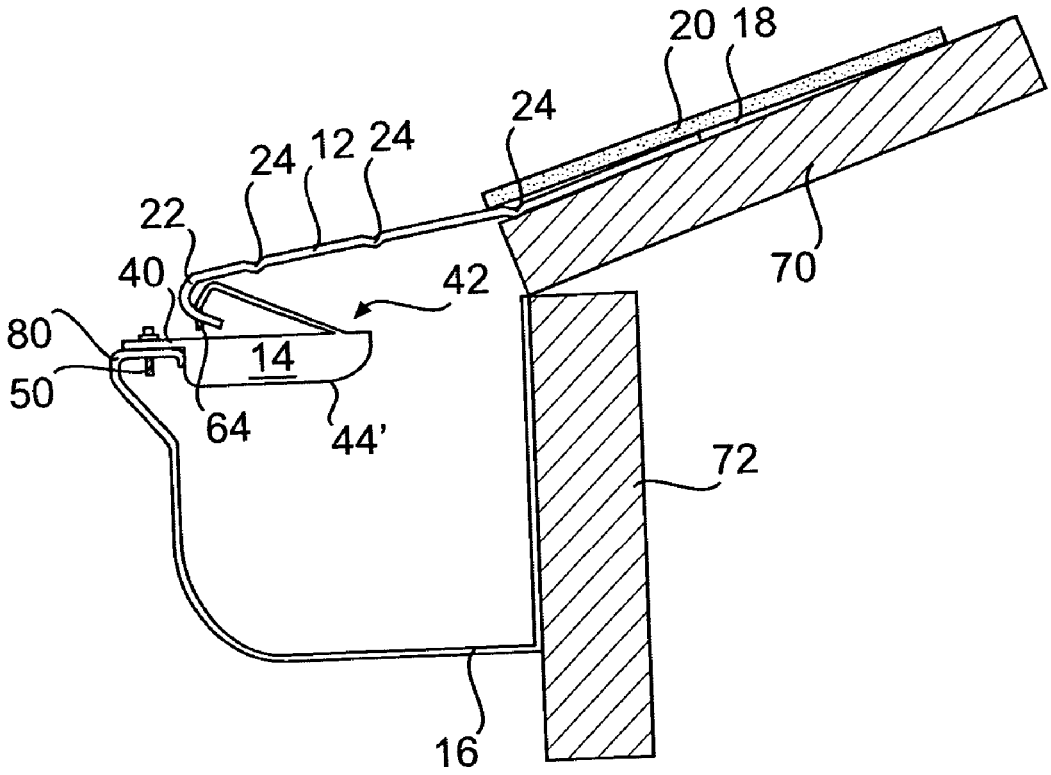
FIG. 7 is a side, cut away view of the gutter cover with a clip wherein the cover is installed along roof and secured to a gutter via the clip in accordance with one embodiment of the present invention.

Turning now to FIG. 7, a cut away profile of gutter cover system 10 is illustrated. Roof edge 18 of cover 12 is secured to a roof 70 by placing the cover under shingles 20. As discussed above, cover 12 is bendable in the transverse direction around one or more of the channels 24. Cover 12 is secured to gutter 16 via clip 14. The gutter itself is attached to a wall or facia board 72, although any method of mounting a gutter to a structure is suitable for purposes of the present invention.

Fastener 50 secures clip 14 to a ledge 80 of gutter 16. Here, ledge 80 is basically perpendicular to the plane of wall 72. However, gutter construction is not universal or uniform, and the angle of ledge 80 with respect to wall 72 can vary between a positive angle to a negative angle.

From this perspective, the utility of wings 44, 44' and tooth 64 is more readily apparent. First, the wings define the position of tab 40 on ledge 80. The tab is flush against ledge 80, and tab 40 is in plane with clip body 30. An installer positions the clip so the wings are in contact with or engage ledge 80 or the inner wall of the gutter. Therefore, each clip will be installed at almost the exact same position along the length of the ledge insuring that the alignment of cover 12 with gutter 16 is consistent along the length of the cover. The installed does not measure, guess, or otherwise determine the correct placement of the clip other than to ensure that the clip is as far forward as possible.

Figure 5:
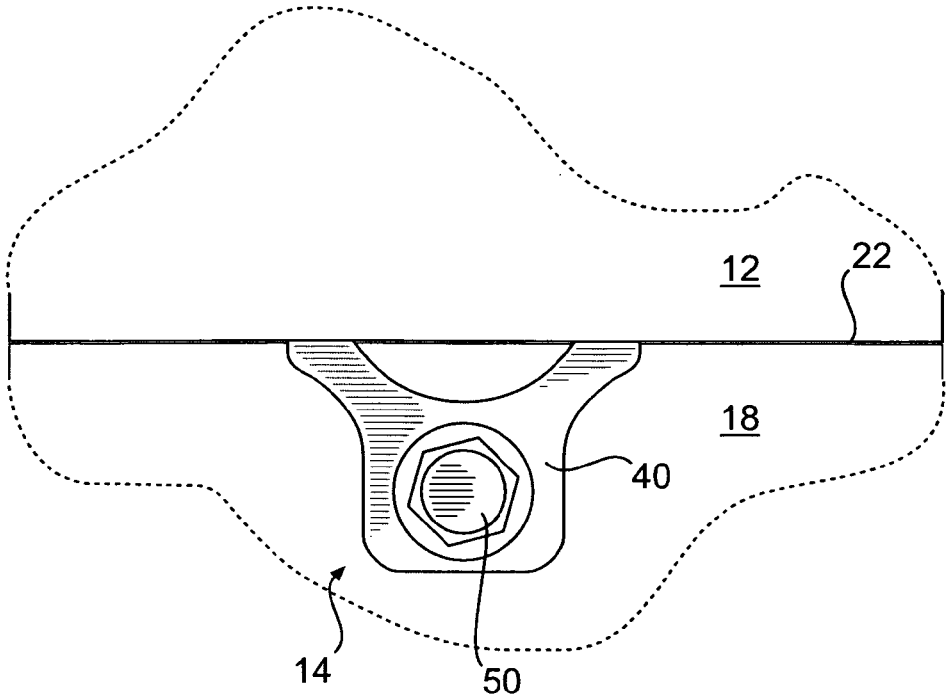
FIG. 5 is a nearly top down view of the clip securing the gutter cover to the gutter in accordance with the present invention.
Figure 6:
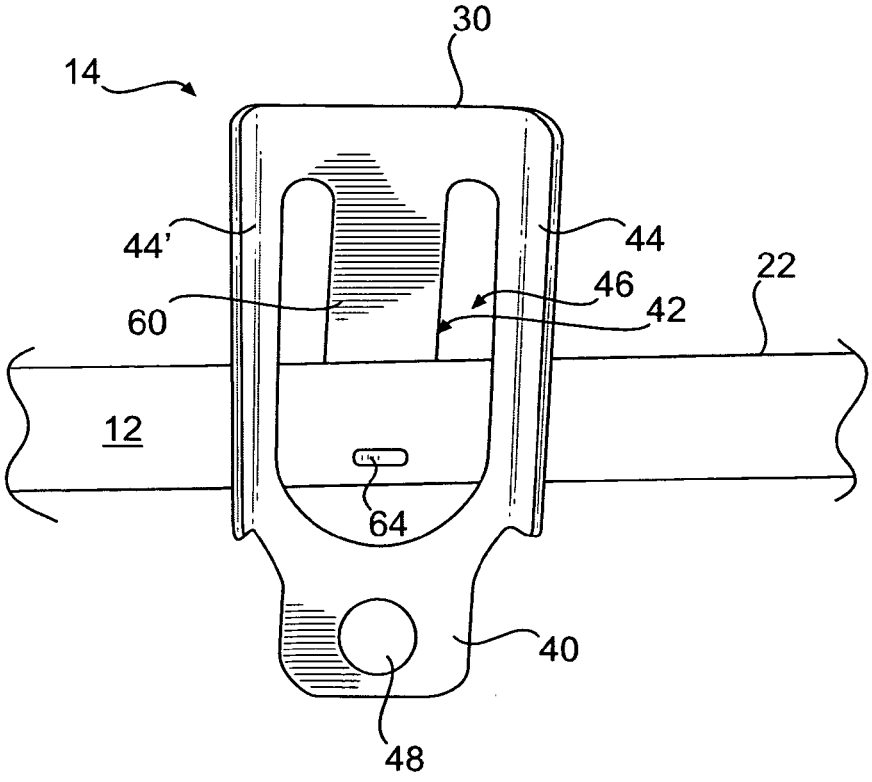
FIG. 6 is a bottom-up view of the clip of the present invention positively secured to the gutter cover.

Positively defining the alignment of the gutter and cover minimizes overlap between edge 22 and ledge 80. There is never a gap where one could look directly down on system 10 and see into the trough defined by the gutter (FIGS. 1 and 5 are not top down perspective views). Ideally, in other words, a line tangent to the outermost point of gutter edge 22 is aligned with the inside point of ledge 90. The edge might slightly overlap some of the ledge, but the positing of the outer point of edge 22 above or near the inside of the ledge affords maximum fluid collection. Water or run-off will not always follow the full length of edge 22. Positing the all or most of the edge vertically above the trough ensures that even water that prematurely disengages from the edge will be collected in the gutter.

Tooth 64 projects through the thickness of cover 12 to provide a positive engagement between clip 14 and cover 12. Advantageously, additional fasteners are not needed to securely connect the clip and cover. As briefly mentioned above, in at least one preferred embodiment, the apertures would be eliminated and the tooth would merely engage edge 22 through friction and arm's downwardly biasing force.

Installation using the system of the present invention facilitates an extremely accurate and fast installation process that resiliently connects a gutter cover to a gutter. In practice, an installer selects an appropriately sized gutter cover panel. The clips are connected to the cover by aligning the clips' teeth with the apertures provided in the radiused edge. A first edge of the cover is placed under a row of shingles on the roof. If necessary, the cover can be bent in the transverse direction to account for the slope of the roof or to facilitate placement of the panel under the shingles. The installer then places the mounting tab of the clip flush against the upper edge of the outside gutter wall. The tab is placed as far forward as the structure of the clip allows. The clip mounting tab is then fastened to the gutter.

While the invention has been described in connection with what is presently considered to be the best practice and preferred embodiments, it is to be understood that the invention is not limited to the disclosed embodiment, but, on the contrary, is intended to cover various modifications and equivalent arrangements included within the spirit and scope of the appended claims, which scope is to be accorded the broadest interpretation so as to encompass all such modifications and equivalent structures.

What is claimed is:

1. A gutter cover system to prevent debris from entering a gutter comprising:

a gutter;

a row of shingles;

an elongated gutter cover comprising a panel with two lengthwise edges, the lengthwise edges comprising a first roof edge located under the row of shingles and a second radiused edge;

a plurality of apertures in the radiused edge;

a clip securing the gutter cover to the gutter, the clip comprising:

a body;

a mounting tab secured to the gutter via a fastener, the mounting tab including an opening and the fastener extending through the tab opening, the mounting tab extending from the body and in-plane with the body;

an arm rising at an angle from the body;

a tooth located on the arm; and wherein the tooth is inserted into one of the apertures in the radiused edge.

2. The system of claim 1, the arm further including a first upward leg and a second downward leg, the tooth located on the downward leg.

3. The system of claim 2, wherein the arm is bendable and provides a biasing force against the cover.

4. The system of claim 3, further comprising a wing substantially transverse to and below the body, the wing placed against the gutter to set the location of the mounting tab on the gutter.

5. The system of claim 4, further comprising a plurality of channels formed in the cover in the lengthwise direction.

6. The system of claim 5, wherein one channel is located under the row of shingles to facilitate bending the elongated cover in the transverse direction.

7. The system of claim 1, wherein the arm provides a biasing force against the cover.

8. The system of claim 1, further comprising a wing substantially transverse to and below the body, the wing placed against the gutter to set the location of the mounting tab on the gutter.

9. The system of claim 1, further comprising a plurality of channels formed in the cover in the lengthwise direction.

10. The system of claim 9, wherein one channel is located under the row of shingles to facilitate bending the elongated cover in the transverse direction.

11. The system of claim 1, further comprising an opening in the body.

12. A gutter cover system to prevent debris from entering a gutter comprising:

a gutter;

an elongated gutter cover including a first radiused edge, the gutter cover including a plurality of apertures in the radiused edge;

a clip securing the gutter cover to the gutter, the clip comprising:

a mounting tab secured to the gutter via a fastener; the tab including an opening and the fastener extending through the tab opening, the mounting tab extending from the body and in-plane with the body;

a body extending from the tab;

an arm rising at an angle from the body, the arm including a first upward leg and a second downward leg;

a tooth on the downward leg;

wherein the tooth is inserted into one of the apertures in the radiused edge, the arm being bendable and providing a biasing force against the cover.

13. The system of claim 12, further comprising a wing substantially transverse to and below the body, the wing placed against the gutter to set the location of the mounting tab on the gutter.

14. The system of claim 12, further comprising a plurality of channels formed in the cover in the lengthwise direction.

15. The system of claim 14, further comprising a row of shingles, the gutter cover including a second edge located under the row of shingles wherein one channel is located under the row of shingles to facilitate bending the elongated cover in the transverse direction.

16. The system of claim 12, further comprising an opening in the body.

17. A gutter cover system to prevent debris from entering a gutter comprising:

a gutter;

an elongated gutter cover including a first radiused edge; a plurality of apertures in the radiused edge;

a clip securing the gutter cover to the gutter, the clip comprising:

a mounting tab secured to the gutter; the tab including an opening and the fastener extending through the tab opening;

a body extending from the tab; the mounting tab extending from the body and in-plane with the body an arm rising at an angle from the body;

a tooth on the arm; the tooth is inserted into one of the apertures in the radiused edge a wing substantially transverse to and below the body, the wing placed against the inside edge of the gutter to set the location of the mounting tab.

18. The system of claim 17, further comprising a plurality of spaced apertures in the radiused edge wherein the tooth is inserted into one of the apertures in the radiused edge.

19. The system of claim 18, further comprising a plurality of channels formed in the cover in the lengthwise direction;

a row of shingles;

the gutter cover including a second edge located under the row of shingles wherein one channel is located under the row of shingles to facilitate bending the elongated cover in the transverse direction.

20. The system of claim 17, further comprising an opening in the body.

21. The system of claim 17, the arm further including a first upward leg and a second downward leg, the tooth located on the downward leg.

22. The system of claim 21, wherein the arm provides a downwardly biasing force against the cover.

* * * * *